US010722057B2

(12) United States Patent
Victor

(10) Patent No.: US 10,722,057 B2
(45) Date of Patent: Jul. 28, 2020

(54) NECK PILLOW

(71) Applicant: Mark Victor, Marietta, GA (US)

(72) Inventor: Mark Victor, Marietta, GA (US)

( * ) Notice: Subject to any disclaimer, the term of this patent is extended or adjusted under 35 U.S.C. 154(b) by 8 days.

(21) Appl. No.: 15/286,228

(22) Filed: Oct. 5, 2016

(65) Prior Publication Data

US 2018/0092475 A1 Apr. 5, 2018

(51) Int. Cl.
*A47C 20/00* (2006.01)
*A47C 9/10* (2006.01)
*A47G 9/10* (2006.01)

(52) U.S. Cl.
CPC ..... *A47G 9/109* (2013.01); *A47G 9/1081* (2013.01); *A47G 2009/1018* (2013.01)

(58) Field of Classification Search
CPC ..... A47G 2009/1018; A47G 9/109; A47G 9/1081
USPC ..... D6/601, 596
See application file for complete search history.

(56) References Cited

U.S. PATENT DOCUMENTS 5,457,832 A * 10/1995 Tatum ..... A61F 5/01 5/636
5,727,267 A * 3/1998 Keilhauer ..... A47G 9/109 5/632
6,574,809 B1 * 6/2003 Rathbun ..... A47G 9/109 5/636
7,578,015 B1 * 8/2009 Wilson ..... A47G 9/1036 5/636
8,813,283 B2 * 8/2014 Alexander ..... A47G 9/1081 5/636
D763,012 S * 8/2016 Maher ..... D6/601
9,757,303 B2 * 9/2017 Marinkovic ..... A61H 1/008
2001/0029630 A1 * 10/2001 Cortese ..... A47G 9/1081 5/636
2011/0094033 A1 * 4/2011 Lee ..... A61F 5/56 5/636
2011/0289689 A1 * 12/2011 Mikkelsen ..... A47G 9/109 5/655.9
2012/0179202 A1 * 7/2012 Pham ..... A61F 5/01 606/240
2013/0298333 A1 * 11/2013 Chen ..... A47G 9/1081 5/636
2013/0305457 A1 * 11/2013 Grunstein ..... A47G 9/10 5/636
2014/0020184 A1 * 1/2014 Loth ..... A47G 9/1081 5/640
2015/0047646 A1 * 2/2015 Marinkovic ..... A61H 1/008 128/845
2015/0150391 A1 * 6/2015 Hsu ..... A47G 9/10 5/636
2015/0351564 A1 * 12/2015 Vogel ..... A47G 9/1081 5/640

(Continued)

*Primary Examiner* — Nicholas F Polito
*Assistant Examiner* — Morgan J McClure
(74) *Attorney, Agent, or Firm* — Georgiy L. Khayet

(57) ABSTRACT

Certain embodiments herein relate to a neck pillow comprising a lower tier and an upper tier. In various embodiments, the lower tier is configured for a user to lay on when sleeping on his or her back, and the upper tier is configured for the user to lay on when sleeping on his or her side. The lower tier and the upper tier may be connected via a middle section. The bottom of the lower tier and the upper tier may comprise a flat bottom that is disposed flat against the surface a user is sleeping on.

5 Claims, 6 Drawing Sheets

(56) References Cited

U.S. PATENT DOCUMENTS

| | | | | |
|---|---|---|---|---|
| 2015/0374149 | A1* | 12/2015 | Wong | A47G 9/1045 5/636 |
| 2016/0192794 | A1* | 7/2016 | Boyd | A47G 9/1081 5/644 |
| 2016/0278553 | A1* | 9/2016 | Biebl | A47G 9/1081 |
| 2017/0326017 | A1* | 11/2017 | Marinkovic | A47G 9/109 |

* cited by examiner

NECK PILLOW

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM, LISTING COMPACT DISC APPENDIX

Not Applicable

BACKGROUND OF THE INVENTION

1. Field of Invention

The present invention relates to a neck pillow with two specific heights that provides a user with support while lying on his or her back or on while lying on his or her side.

2. Description of Prior Art

A pillow for sleeping typically is rectangular, flat, and comprises no special support of the back or neck. However, often times users find different levels of pillow thickness facilitates a more comfortable sleep based on the position the user is sleeping. For instance, if the user is laying on his or her back, they may wish to use a pillow with a relatively low thickness. Alternatively, if the user is laying on his or her side, they may wish to use a pillow with a relatively higher thickness. Regardless, healthy or ill, young or old, the user may get serious problems in their neck if the height and/or the thickness of the pillow is not correct. Nonetheless, most conventional pillows are manufactured only as a standard size pillow, where the support provided by the pillow is not adjustable, thereby requiring the user to use multiple pillows of different firmness or height to provide desired comfort. Additionally, conventional pillows surround the head and often cause headaches and they also arch the head forward which pinch the neck muscles and nerves which causes neck soreness during the day.

SUMMARY OF THE INVENTION

Embodiments of the present invention provide for a neck pillow with two specific heights that provides a user with varying levels of supports while lying in different sleeping positions. The neck pillow may comprise a lower tier configured for a user to lay on when sleeping on his or her back. In various embodiments, the lower tier may be circular in shape and comprise a six-inch diameter, which fits under the neck of the user and is sized to stretch the user's neck muscles and cervical vertebrae over the lower tier, thereby eliminating neck pain during sleep and during daily activities. Additionally, the neck pillow may comprise an upper tier configured for when the user to lay on when sleeping on his or her side. In certain embodiments, the upper tier may be circular in shape and comprise an eight-inch diameter, which is taller than the lower tier and configured to keep the cervical vertebras aligned while the user is sleeping on his or her side, thereby keeping the neck slightly arched-up and not pinched. The lower tier and the upper tier may be connected via a middle section. In one embodiment, the middle section may be a gradual tapering between the six-inch diameter of the lower tier and the eight-inch diameter of the upper tier. In an alternative embodiment, the middle section may be more abrupt, thereby forming a resting transition piece for the user's head to lay against when the user's head is resting on the lower tier of the neck pillow. The bottom of the lower tier and the upper tier may comprise a flat bottom in order for the neck pillow to be position on a flat surface the user is sleeping on, such as, for example, a bed or a floor. While the user is either on his or her side or back position, the neck pillow allows the head to be free from contact with the sleeping surface and prevents the application pressure on the head while the user is sleeping. Additionally, when the user is on his or her side or back position, the neck pillow maintains a straight align of the neck while the user is sleeping.

One feature and advantage of the present invention is its ability to open the airways during rest in order to promote anabolic process for muscle-recovery during rest.

Another feature and advantage of present invention is its ability to stretch neck muscles and cervical vertebrae during rest, thereby diminishing neck pain during sleep.

Yet another feature and advantage of the present invention is its ability to reduce snoring by facilitating opening of the larynx while the user is sleeping.

Still yet another feature and advantage of the present invention is its ability to reduce head pain by not surrounding the cranium with pillow during sleep, thereby allowing the cranium to be free from contact during back-position sleeping.

Yet another feature and advantage of the present invention is its ability to reduce acid reflux by keeping the neck slightly arched-up and not pinched.

Still yet another feature and advantage of the present invention is its ability to reduce napping by proving a more complete rest.

These and other exemplary features and advantages of the present invention will become clear from the following description with reference to the accompanying drawings.

BRIEF DESCRIPTION OF THE DRAWINGS

The following drawings form part of the specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention. However, one skilled in the art will understand that portions of the example or aspect may be used in combination with other examples or aspects of the invention.

DETAILED DESCRIPTION

The present disclosure relates to a neck pillow that provides a user with two specific heights, a lower tier and an upper tier, each designed to facilitate support of the user's neck while sleeping in different sleeping positions. In certain embodiments, the lower tier may be configured for when the user is laying on his or her back and sized to be positioned under the neck of the user. The upper tier may be configured for when the user is laying on his or her side and sized to keep the neck slightly arched and not pinched.

Figure 1:
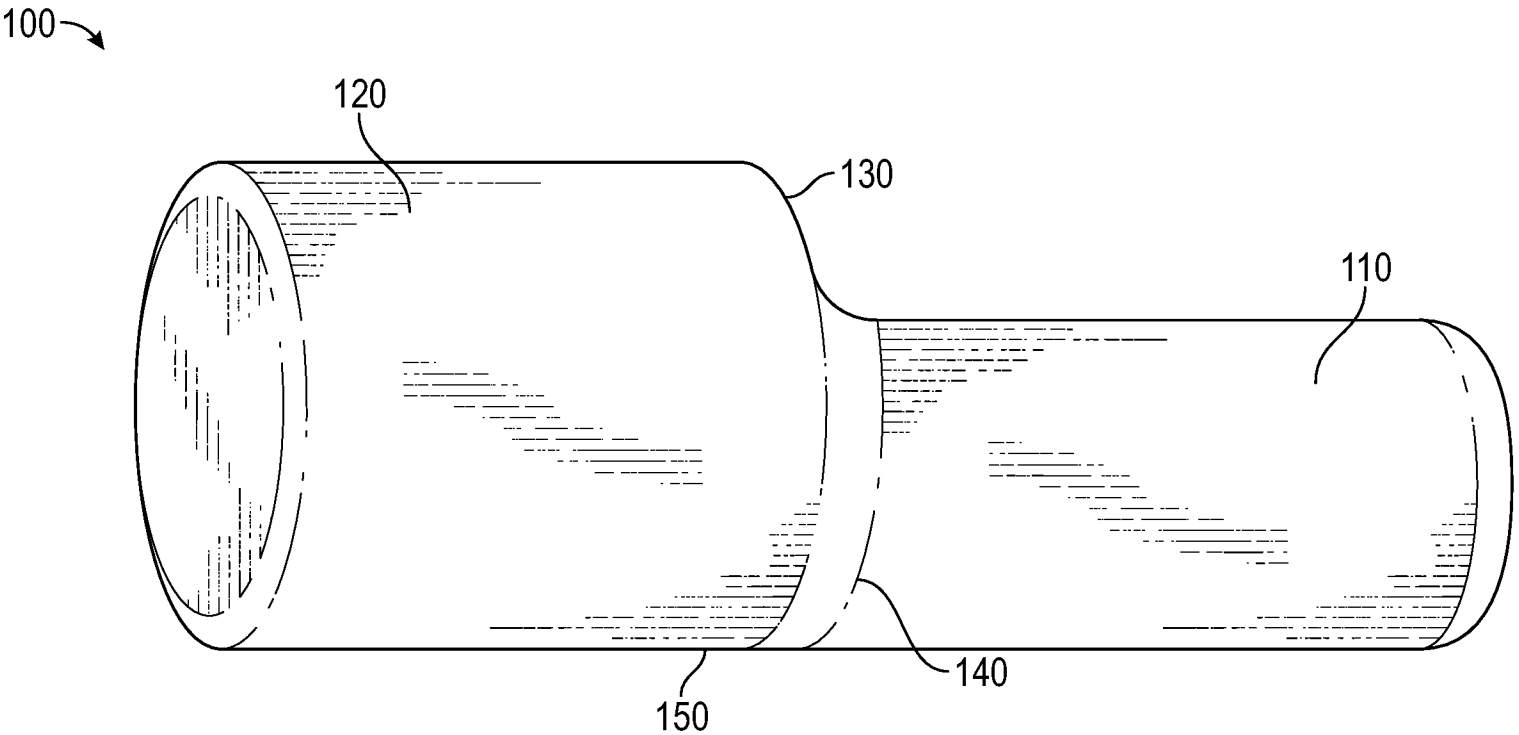
FIG. 1 is a front view of a neck pillow, according to an embodiment of the disclosure.

Referring now to FIG. 1, shown a front view of a neck pillow 100 according to an embodiment of the disclosure. As shown in FIG. 1, in certain embodiments, the neck pillow 100 may include a lower tier 110 and an upper tier 120, each extending across the width of the neck pillow 100. In certain embodiment, the lower tier 110 may be circular in shape and have a diameter of about six inches. Additionally, in certain embodiments, the upper tier 120 may be circular in shape and have a diameter of about eight inches. The lower tier 110 and the upper tier 120 having different heights allows the user to freely select the side of the neck pillow 100 that most comfortably supports the user's neck, thereby facilitating a good sleep as discussed more in FIGS. 3-5. In certain embodiments, it is envisioned that the diameters of the lower tier 110 and the upper tier 120 may be greater or smaller than six and eight inches, respectively. Additionally, it is envisioned that the lower tier 110 and the upper tier 120 may comprise other shapes that are suitable for supporting a user's neck during sleep.

According to one embodiment of the present invention, the neck pillow 100 may be integrally molded from a soft material, which may be a memory foam or/and Dacron foam or other suitable material configured to support a user's neck while sleeping.

With continued reference to FIG. 1, the top side of the lower tier 10 and the upper tier 120 of the neck pillow 100 may be connected via a middle section 130. In certain embodiments, the middle section 130 may be a gradual tapering between the six-inch diameter of the lower tier 110 and the eight-inch diameter of the upper tier 120. In alternative embodiments, the middle section 130 may be more abrupt, thereby forming a resting transition piece for the user's head to lay against when the user's head is resting on the lower tier 110. In certain embodiments, the tapering of the middle section 130 may extend around the length or of the neck pillow 100, as shown by 140.

Still referring to FIG. 1, the neck pillow 100 may further comprise flat bottom 150, where the bottom of the neck pillow 100 may lay flat on the surface the user is sleeping on, such as a bed or a floor.

Figure 2:
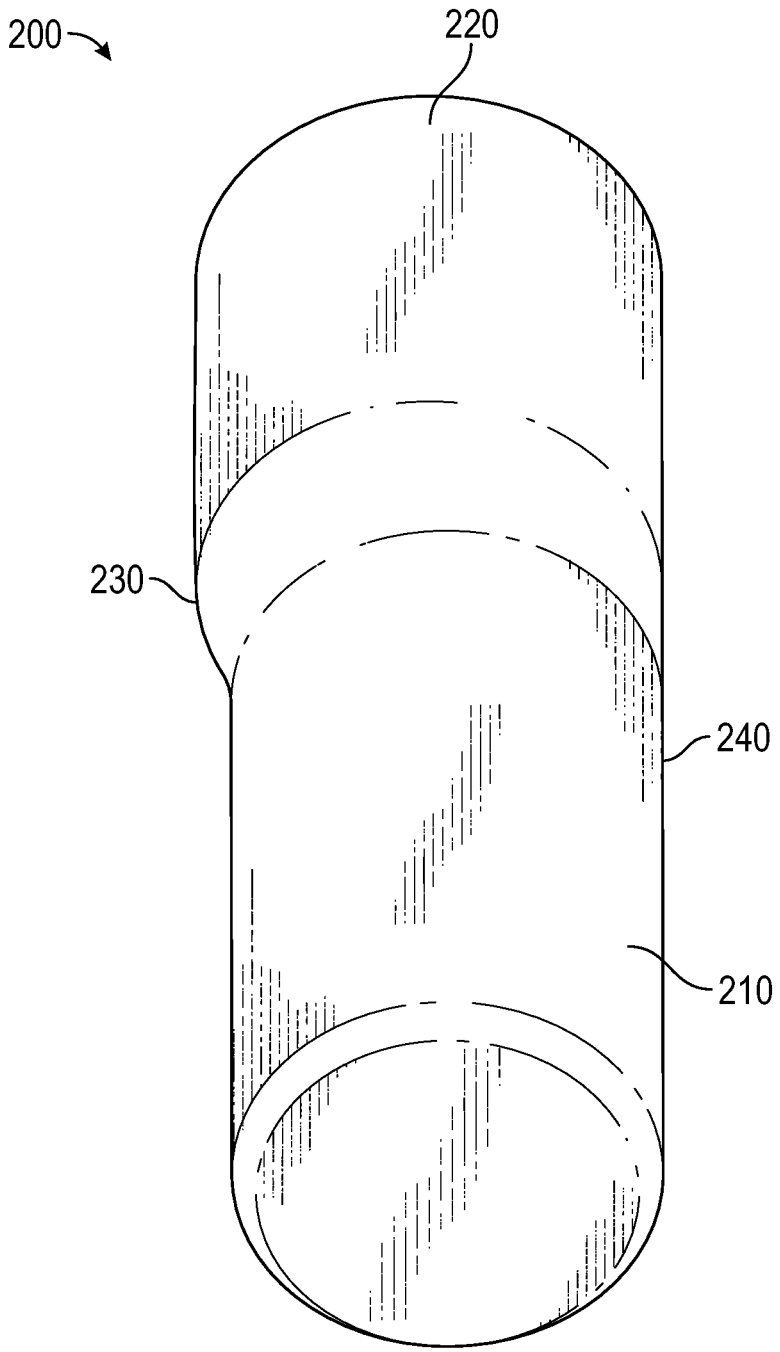
FIG. 2 is a side view of a neck pillow, according to an embodiment of the disclosure.

Referring now to FIG. 2, shown a side view of a neck pillow 200, according to an embodiment of the disclosure. As discussed above, the neck pillow 200 may comprise lower tier 210 and upper tier 220, where the lower tier 210 and the upper tier 220 are connected via a middle section 230. As shown in FIG. 2, the middle section 230 may be tapered (or may be abrupt) and extend partially around the circumference of the neck pillow, except for a flat bottom 240 of the neck pillow, which may be substantially flat and be disposed on a surface a user is lying on.

Figure 3:
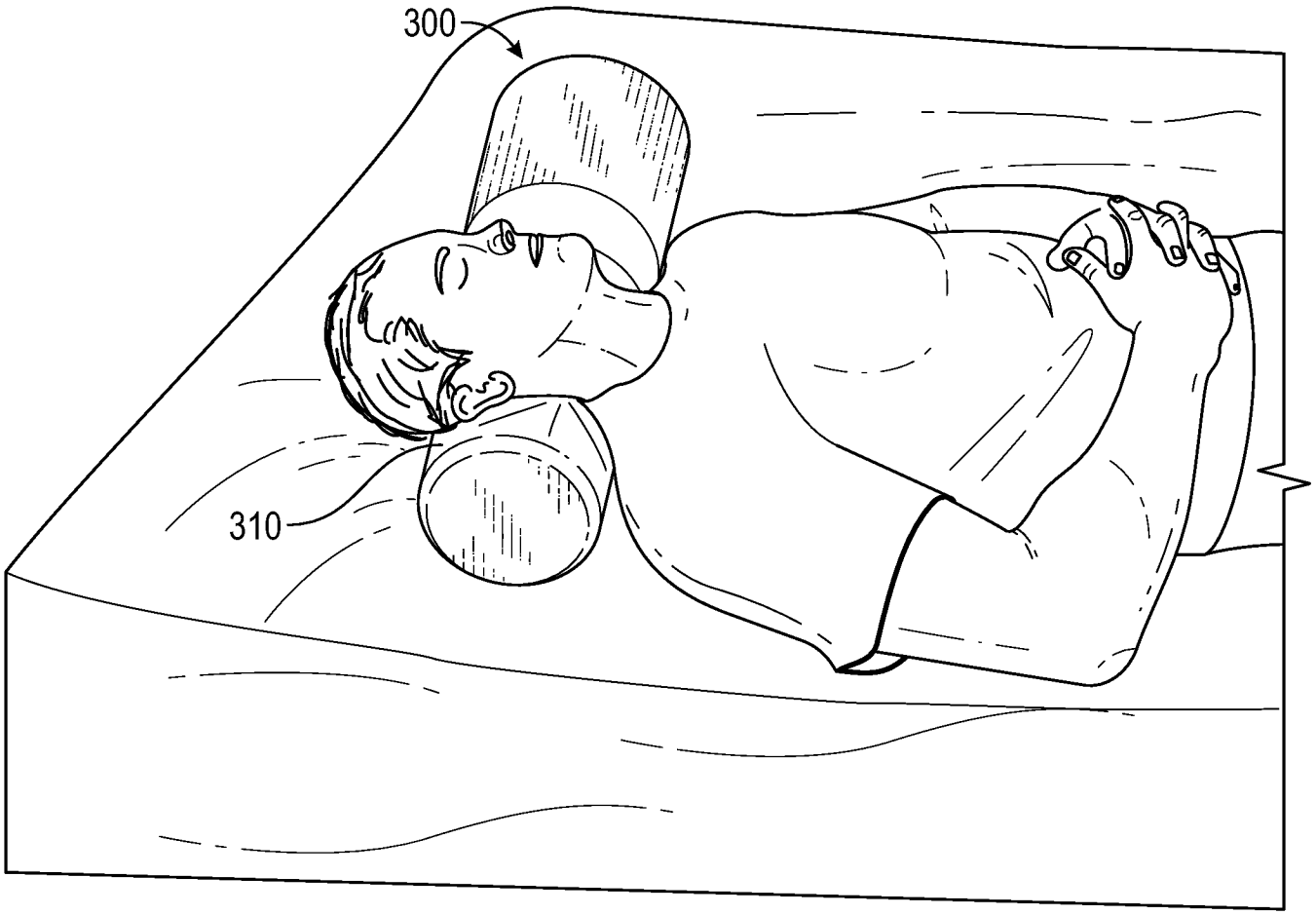
FIG. 3 is a view of the neck pillow in use, according to an embodiment of the disclosure.

Referring now to FIG. 3, shown is a view of a neck pillow 300 in use, according to an embodiment of the disclosure. More specifically, FIG. 3 shows a user using a lower tier 310 of the neck pillow 300 when the user is sleeping on his or her back (as shown). In certain embodiments, the lower tier 310 is configured to fit under the neck of the user, and sized to keep the cervical vertebras (C1, C2, C3, C4, C5, C6, and C7) aligned while the user is sleeping. Accordingly, the technical effects of using the lower tier 310 of the neck pillow 300 while the user is sleeping on his or her back is to allow the user to stretch his or her neck muscles and cervical vertebrae over the lower tier 310, thereby eliminating neck pain during sleep. Another technical effect of using the lower tier 310 of the neck pillow 300 is to not surround the cranium with pillow during sleep.

Figure 4:
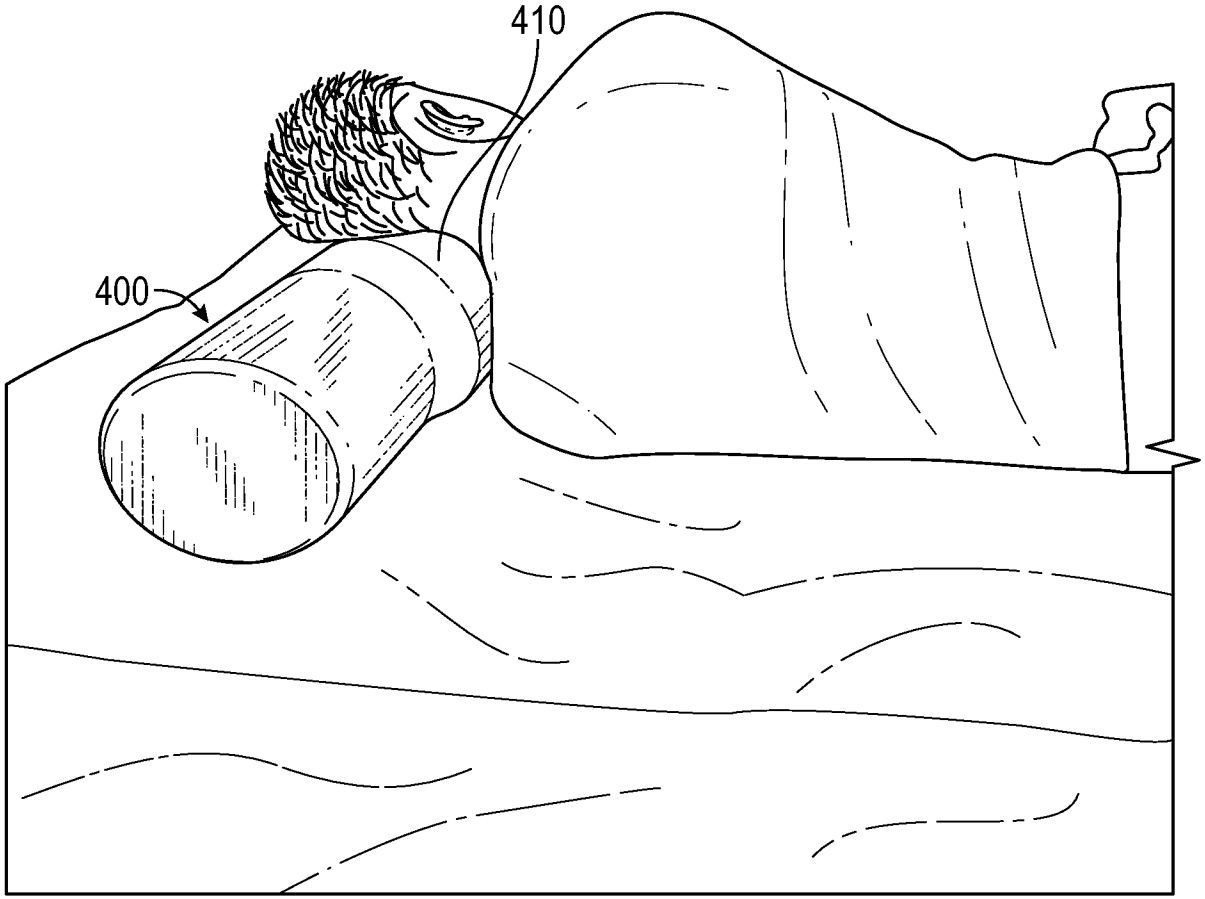
FIG. 4 is a view of the neck pillow in use, according to another embodiment of the disclosure.

Referring now to FIG. 4, shown is a view of a neck pillow 400 in use, according to yet another embodiment of the disclosure. More specifically, FIG. 4 shows a user using an upper tier 410 of the neck pillow 400 when the user is on his or her side (as shown). In certain embodiments, the upper tier 410 is taller than the lower tier (referred to as 310 in FIG. 3) and is configured to keep the cervical vertebras (C1, C2, C3, C4, C5, C6, and C7) aligned while the user is sleeping on his or her side. Accordingly, the technical effects of using the upper tier 410 of the neck pillow 400 is its ability to reduce snoring by facilitating opening of the larynx during rest time. Additionally, another technical effects of using the upper tier 410 of the neck pillow 400 while the user is sleeping on his or her side is its ability to reduce acid reflux by keeping the neck slightly arched-up and not pinched.

Figure 5:
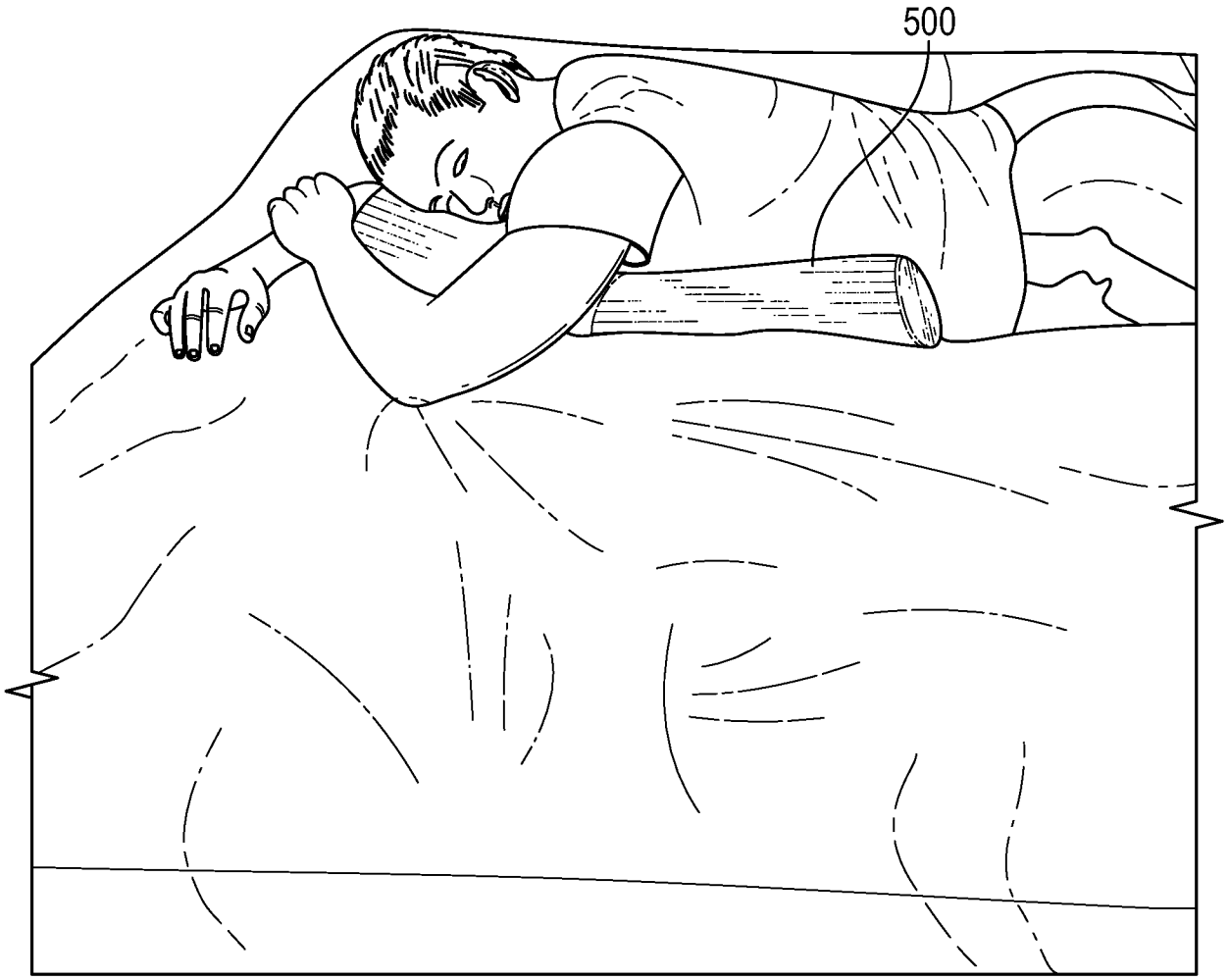
FIG. 5 is a view of the neck pillow in use, according to yet another embodiment of the disclosure.

Referring now to FIG. 5, shown is a view of a neck pillow 500 in use, according to yet another embodiment of the disclosure. As shown in FIG. 5, the neck pillow 500 may be cradled or held by the user while sleeping.

Figure 6:
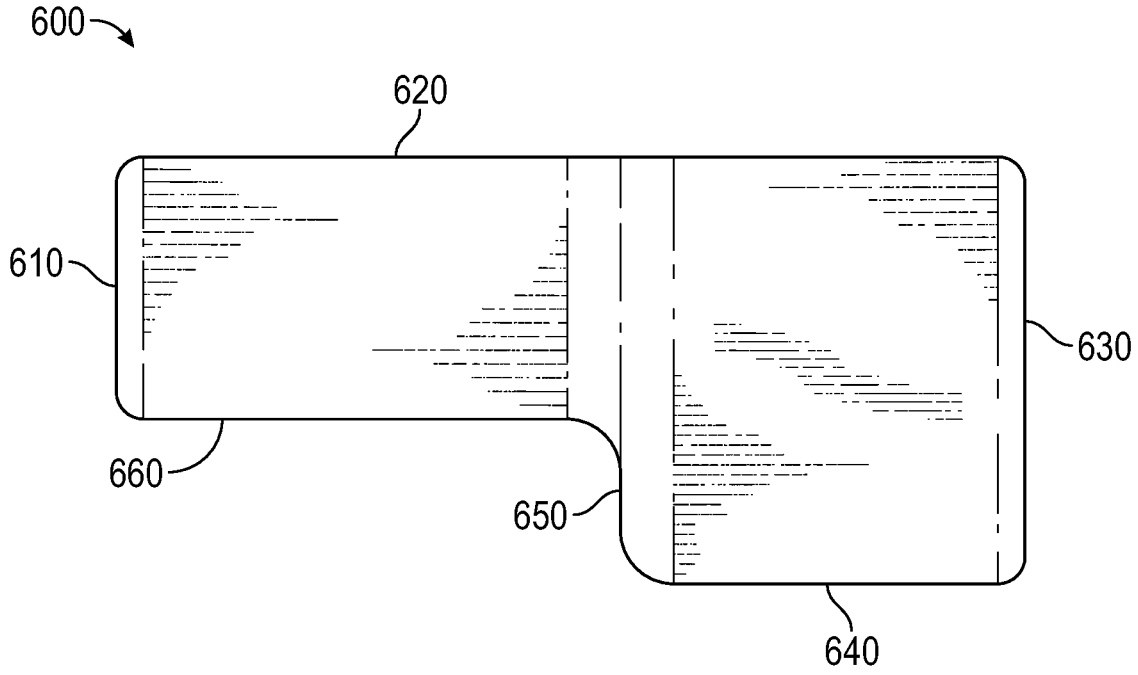
FIG. 6 is a front view of a cover for the neck pillow, according to an embodiment of the disclosure.

Referring now to FIG. 6, shown is a front view of a cover 600 for the neck pillow, according to an embodiment of the disclosure. The cover 600 may be configured to be a pillowcase that can fit around the neck pillow (referred to as 100 in FIG. 1). In certain embodiments, the cover 600 may comprise edges 610, 620, 630, 640, 650, and 660, which may be 14, 48, 28, 28, 13, 20 inches respectively.

Definitions

The following definitions are included to provide a clear and consistent understanding of the specification and claims. As used herein, the recited terms have the following meanings. All other terms and phrases used in this specification have their ordinary meanings as one of skill in the art would understand.

References in the specification to "one embodiment", "an embodiment", etc., indicate that the embodiment described may include a particular aspect, feature, structure, moiety, or characteristic, but not every embodiment necessarily includes that aspect, feature, structure, moiety, or characteristic. Moreover, such phrases may, but do not necessarily, refer to the same embodiment referred to in other portions of the specification. Further, when a particular aspect, feature, structure, moiety, or characteristic is described in connection with an embodiment, it is within the knowledge of one skilled in the art to affect or connect such aspect, feature, structure, moiety, or characteristic with other embodiments, whether or not explicitly described.

The singular forms "a," "an," and "the" include plural reference unless the context clearly dictates otherwise. Thus, for example, a reference to "a compound" includes a plurality of such compounds, so that a compound X includes a plurality of compounds X. It is further noted that the claims may be drafted to exclude any optional element. As such, this statement is intended to serve as antecedent basis for the use of exclusive terminology, such as "solely," "only," and the like, in connection with any element described herein, and/or the recitation of claim elements or use of "negative" limitations.

The term "and/or" means any one of the items, any combination of the items, or all of the items with which this term is associated. The phrase "one or more" is readily understood by one of skill in the art, particularly when read in context of its usage.

As used herein, the term "about" refers to an approximately +/−10% variation from a given value. It is to be understood that such a variation is always included in any given value provided herein, whether or not it is specifically referred to.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, for use in an explicit negative limitation.

The claimed invention is:

1. A neck pillow, comprising:

a lower tier, wherein the lower tier is configured for a neck of a user to lay on and enables a head of the user to be free from contact with the neck pillow and in contact with a sleeping surface when sleeping on their back, wherein the lower tier is cylindrical in shape; and an upper tier, wherein the upper tier is configured for the neck of the user to lay on and enables the head of the user to be free from contact with the neck pillow and free from contact with the sleeping surface when sleeping on their side, wherein the upper tier has an outer surface, the outer surface being cylindrical in shape, wherein each part of the outer surface of the upper tier is capable of contacting with the sleeping surface; and wherein the lower tier has a first circular side surface and the upper tier has a second circular side surface, wherein the first circular side surface of the lower tier and the second circular side surface of the upper tier are connected via a middle section, wherein a bottom of the lower tier, a bottom of the upper tier, and a bottom of the middle section are in line with each other to contact the sleeping surface along an entire length of the bottom of the lower tier, the bottom of the upper tier, and the bottom of the middle section, wherein the bottom of the middle section is flat and a remaining portion of the middle section partially extends around a circumference of the first circular side surface of the lower tier and gradually connects the first circular side surface of the lower tier and the second circular side surface of the upper tier, and wherein a diameter of the lower tier is smaller than a diameter of the upper tier.

2. The neck pillow of claim 1, wherein the lower tier is six inches in diameter.

3. The neck pillow of claim 1, wherein the upper tier is eight inches in diameter.

4. The neck pillow of claim 1, wherein the middle section is abrupt and forms an edge between the lower tier and the upper tier.

5. The neck pillow of claim 1, wherein the middle section is a gradual tapering between the lower tier and the upper tier.

* * * * *